US005426494A

United States Patent [19]

Muto et al.

[11] Patent Number: 5,426,494

[45] Date of Patent: Jun. 20, 1995

[54] ELECTROPHOTOGRAPHIC DEVICE AND METHOD FOR SHORTENING A PRINT TIME

[75] Inventors: Kiyoshi Muto, Yokkaichi; Shinken Ozeki, Gifu, both of Japan

[73] Assignee: Brother Kogyo Kabushiki Kaisha, Nagoya, Japan

[21] Appl. No.: 103,679

[22] Filed: Aug. 10, 1993

[30] Foreign Application Priority Data

Sep. 18, 1992 [JP] Japan ..... 4-249414

[51] Int. Cl.[6] ..... G03G 15/20; G03G 21/00

[52] U.S. Cl. ..... 355/285; 219/216; 355/208

[58] Field of Search ..... 355/203, 204, 208, 282, 355/285, 290; 219/216, 469; 432/60

[56] References Cited

U.S. PATENT DOCUMENTS

| | | | |
|---|---|---|---|
| 4,324,486 | 4/1982 | Nishikawa | 219/216 X |
| 5,073,799 | 12/1991 | Watanabe | 355/285 |
| 5,280,328 | 1/1994 | Goto et al. | 355/285 |
| 5,303,015 | 4/1994 | Sato | 355/285 |

FOREIGN PATENT DOCUMENTS

| | | | |
|---|---|---|---|
| 0159570 | 10/1985 | European Pat. Off. | 355/285 |
| 57-54970 | 4/1982 | Japan | 355/285 |
| 62-116981 | 5/1987 | Japan | 355/285 |
| 2-12186 | 1/1990 | Japan | 355/285 |
| 4-140765 | 5/1992 | Japan | 355/285 |

*Primary Examiner*—William J. Royer
*Attorney, Agent, or Firm*—Oliff & Berridge

[57] ABSTRACT

In an electrophotographic device, a heat roller is heated by a heater, and upon instruction of start of a print operation, the temperature Tf of the heat roller is detected by a temperature sensor. When the temperature Tf is above a predetermined temperature Tv at which high voltage is applied, the high voltage is applied. Thereafter, the temperature Tf of the heat roller is detected again, and if the temperature Tf is above a predetermined temperature Ts at which the sheet is fed, the solenoid clutch is switched on to feed the sheet. If the print operation is not terminated, the temperature of the heat roller is detected again, and it is checked whether the temperature of the heat roller is above a predetermined fixing temperature Tp.

18 Claims, 7 Drawing Sheets

| ITEM | INSTRUCTIONS |
|---|---|
| S6 | PRINT CONTROL |
| S61 | FEED SHEET TO RESIST ROLLERS AND KEEP IT ON STANDBY |
| S63 | READ TEMPERATURE (Tf) OF HEAT ROLLER |
| S65 | Tf ≧ Tv(158°C) ? |
| S67 | APPLY HIGH VOLTAGE |
| S69 | TURN ON HEATER |
| S71 | READ TEMPERATURE (Tf) OF HEAT ROLLER |
| S73 | Tf ≧ Ts (165°C) ? |
| S75 | SWITCH ON SOLENOID CLUTCH TO START FEEDING OF SHEET |
| S77 | HEATER TURNED ON ? |
| S79 | TURN ON HEATER |
| S81 | PRINT TERMINATED ? |
| S83 | HEATER TURNED ON ? |
| S85 | TURN OUT HEATER |
| S87 | READ TEMPERATURE (Tf) OF HEAT ROLLER |
| S89 | Tf ≧ Tp(170°C) ? |
| S91 | HEATER TURNED ON ? |
| S93 | TURN OUT HEATER |
| S95 | HEATER TURNED ON ? |
| S97 | TURN ON HEATER |

| ITEM | INSTRUCTIONS |
|---|---|
| S6 | PRINT CONTROL |
| S61 | FEED SHEET TO RESIST ROLLERS AND KEEP IT ON STANDBY |
| S63 | READ TEMPERATURE (Tf) OF HEAT ROLLER |
| S65 | Tf ≧ Tv(158°C) ? |
| S67 | APPLY HIGH VOLTAGE |
| S69 | TURN ON HEATER |
| S71 | READ TEMPERATURE (Tf) OF HEAT ROLLER |
| S73 | Tf ≧ Ts (165°C) ? |
| S75 | SWITCH ON SOLENOID CLUTCH TO START FEEDING OF SHEET |
| S77 | HEATER TURNED ON ? |
| S79 | TURN ON HEATER |
| S81 | PRINT TERMINATED ? |
| S83 | HEATER TURNED ON ? |
| S85 | TURN OUT HEATER |
| S87 | READ TEMPERATURE (Tf) OF HEAT ROLLER |
| S89 | Tf ≧ Tp(170°C) ? |
| S91 | HEATER TURNED ON ? |
| S93 | TURN OUT HEATER |
| S95 | HEATER TURNED ON ? |
| S97 | TURN ON HEATER |

FIG.3B

| ITEM | INSTRUCTIONS |
|---|---|
| S101 | FEED SHEET TO RESIST ROLLERS AND KEEP IT ON STANDBY |
| S103 | READ TEMPERATURE (Tf) OF HEAT ROLLER |
| S105 | Tf ≧ Ts(165°C) ? |
| S107 | APPLY HIGH VOLTAGE |
| S109 | SWITCH ON SOLENOID CLUTCH TO START FEEDING OF SHEET |
| S111 | TURN ON HEATER |
| S113 | PRINT TERMINATED ? |
| S115 | HEATER TURNED ON ? |
| S117 | TURN OUT HEATER |
| S119 | READ TEMPERATURE (Tf) OF HEAT ROLLER |
| S121 | Tf ≧ Tp(170°C) ? |
| S123 | HEATER TURNED ON ? |
| S125 | TURN OUT HEATER |
| S127 | HEATER TURNED ON ? |
| S129 | TURN ON HEATER |

FIG.5B

ELECTROPHOTOGRAPHIC DEVICE AND METHOD FOR SHORTENING A PRINT TIME

BACKGROUND OF THE INVENTION

1. Field of the Invention

This invention relates to an electrophotographic device and method in which a print time required for printing a first print sheet is shortened.

2. Description of the Related Art

The construction and operation of the laser printer will be described with reference to FIG. 4.

When a sheet 11 is fed from an automatic sheet supply device 10, which is provided at a lower side in a laser printer body 1, the sheet 11 is fed to an image forming portion 15 while being guided by a sheet guide 12. If at this time a sheet detection sensor 13, provided adjacent the sheet guide 12, detects that the sheet 11 passes therethrough, in response to a sheet detection signal, a pair of resist rollers, which are provided downstream of the sheet guide 12 with respect to the sheet detection sensor 13, starts their rotational motion after a predetermined time elapses. The sheet 11 is subjected to a distortion correcting treatment in contact with the resist rollers 14 and is fed to the downstream side of the sheet guide 12 through the rotational motion of the resist rollers 14 while being sandwiched by the resist rollers 14. The sheet 11 is guided by a sheet guide 16 provided at the downstream side of the resist rollers 14 and fed to the image forming portion 15 while being guided by a carry roller 17 provided at the downstream side of the sheet guide 16 so as to be in close contact with a photosensitive drum 20.

In the vicinity of the image forming portion 15 are provided a scanner unit 21 for performing an exposure process to form an electrostatic latent image on the photosensitive drum 20, a developing device 22 for developing the electrostatic latent image formed by the exposure process, an image transfer portion 18 for transferring the developed electrostatic latent image onto the sheet 11, and a discharger 19 for discharging the sheet 11 to exfoliate the sheet from the photosensitive drum 20 after the image transferring process. In the image forming portion 15, the electrostatic latent image is formed on the photosensitive drum 20 by the exposure process of the scanner unit 21, and developed by charged toner that is supplied from the developing device 22. A toner image that has been developed through the developing process in the image transfer portion 18 is transferred onto the sheet 11. The charged sheet 11 is discharged in the discharger 19 after the image transfer process. The charged sheet 11 is brought to a state where no electrical affection is given to the sheet 11 and exfoliated from the photosensitive drum 20.

The sheet 11, which has been discharged in the discharger 19, is guided to a carry guide portion 23 disposed at the downstream side of the image forming portion 15 and fed to a fixing device 24 disposed at a further downstream side. After the toner image on the sheet 11 is fully fixed, the sheet 11 is guided to a sheet discharge portion 27 and fed onto a sheet discharge tray 29 through rotation of a pair of discharge rollers 28.

A heat roller 25 for fixing the toner image on the sheet 11 is provided in the fixing device 24. The heat roller 25 is provided with a heater 26 to supply heat to the heat roller 25. A temperature sensor 31 for detecting temperature of the heat roller 25 is secured to a frame of the fixing device 24 so as to be contacted with the heat roller under pressure. Further, a support roller 32 is provided so as to be paired with the heat roller 25. The sheet 11 fed from the carry guide portion 23 is pinched by the heat roller 25 and the support roller 32 and fed from the fixing device 24 to the sheet discharge portion 27 by feed-out rollers 33. A fan motor 30 is provided in the vicinity of the fixing device 24.

In the laser printer thus constructed, simultaneously with the start of a print operation, the heater 26 in the fixing device 24 is turned on to heat the heat roller 25. Upon the turn-on of the heater 26, the inside of the printer body 1 is warmed by the heat. In order to prevent the output power of a laser beam from being fluctuated due to the warming of the scanner unit 21, etc., the fan motor 30 is rotated to discharge warmed air in the printer body 1 to the outside of the printer body 1, so that the inside of the printer body 1 is cooled. The temperature of the heat roller 25 is detected by the temperature sensor 31, which is contacted with the heat roller 25 under pressure. If the detected temperature is below a predetermined temperature, the heater 26 is turned on, while if the detected temperature is above the predetermined temperature, the heater 26 is turned out. Through this operation, the heat roller 25 is controlled so that its temperature becomes constant.

Conventionally, in the laser printer thus constructed, the temperature of the heat roller 25 is detected by the temperature sensor 31 upon start of the print operation.

After the detected temperature reaches a temperature above a predetermined fixing temperature at which the toner image transferred onto the sheet 11 is fully fixed on the sheet 11, a high voltage is applied to the developing device 22 to drive the developing device 22 containing the photosensitive drum 20, the image transfer portion 18, the discharger 19, etc., and the feeding operation of the sheet 11 is started after a predetermined time elapses. Subsequently, the toner image is formed on the sheet 11 in the image forming portion 15, and the sheet 11 is fed to the fixing device.

As described above, in the conventional electrophotographic device, after the temperature of the heat roller 25 reaches the predetermined temperature, the high voltage is applied, and the sheet feeding operation of the sheet 11 is started. Therefore, a print time required for completely printing a first sheet (first print time) is extremely long. That is, it takes several seconds for the temperature of the heat roller 25 to reach the predetermined value, and further it takes several seconds for the developing device 22 to be supplied with high voltage and kept in a development-permissible state. In addition, it takes several seconds for the sheet 11 to be fed to a predetermined position where the toner image is transferred onto the sheet 11. Therefore, several seconds, for example 13 to 14, are required to prepare the print operation for the first sheet, and about 23 to 24 seconds are required from the termination of the print operation for the first sheet until the discharging operation of the first sheet.

SUMMARY OF THE INVENTION

This invention has been implemented to solve the above problem and has an object to provide an electrophotographic device and method in which a print time is shortened by starting a feeding operation of a sheet to an image forming portion simultaneously with or after application of a high voltage to the image forming portion before a temperature of a fixing device, which is detected by detection means, reaches a predetermined value.

In order to attain the above object, an electrophotographic device according to this invention, in which a developing agent image formed on an image support member is transferred onto a transfer member to form an image in an image forming portion, and the image formed on the transfer member is heat-fixed on the transfer member by a fixing device, including heating means for heating the fixing device, temperature detection means for detecting temperature of the fixing device heated by the heating means, high-voltage applying means for applying a high voltage to the image forming portion, sheet feeding means for feeding a sheet to the image forming portion, and control means for controlling the sheet feeding means to feed the sheet simultaneously with or after the application of the high voltage by the high-voltage applying means before the temperature detected by the temperature detection means reaches a predetermined value. The control means includes first comparison means for comparing the temperature of the fixing device with a first temperature lower than the predetermined value, and second comparison means for comparing the temperature of the fixing device with a second temperature lower than the first temperature. When the temperature of the fixing device is judged to be above the second temperature by the second comparison means, the high-voltage applying means applies the high voltage to the image forming portion. When the temperature of the fixing device is judged to be above the first temperature by the first comparison means, the sheet feeding means feeds the sheet.

In the electrophotographic device thus constructed, the fixing device is heated by the heating means, and the temperature of the fixing device is detected by the temperature detection means. Before the detected temperature reaches the predetermined value, under the control of the control means, the sheet is fed to the image forming portion by the sheet feeding means at the same time after the high voltage is applied to the image forming portion by the high-voltage applying means.

Specifically, the second comparison means compares the temperature of the fixing device with the second temperature, which is lower than the first temperature lower than the predetermined value, and if the second comparison means judges the temperature of the fixing device to be above the second temperature, the high-voltage applying means applies a high voltage to the image forming portion. On the other hand, the first comparison means compares the temperature of the fixing device with the first temperature, which is lower than the predetermined temperature, and if the first comparison means judges the temperature of the fixing device to be above the first temperature, the sheet feeding means feeds the sheet.

According to the electrophotographic device of this invention, before the temperature of the fixing device reaches the predetermined value, the high voltage is applied to the image forming portion, and at the same time or thereafter the sheet feeding operation is started. Therefore, a first print time can be shortened.

BRIEF DESCRIPTION OF THE DRAWINGS

FIGS. 3A and 3B are a flowchart showing the operation of the laser printer according to this embodiment when a printing operation is carried out;

FIGS. 5A and 5B are a flowchart showing an operation of the laser printer according to a second embodiment when the print operation is carried out.

DETAILED DESCRIPTION OF PREFERRED EMBODIMENTS

Figure 4:
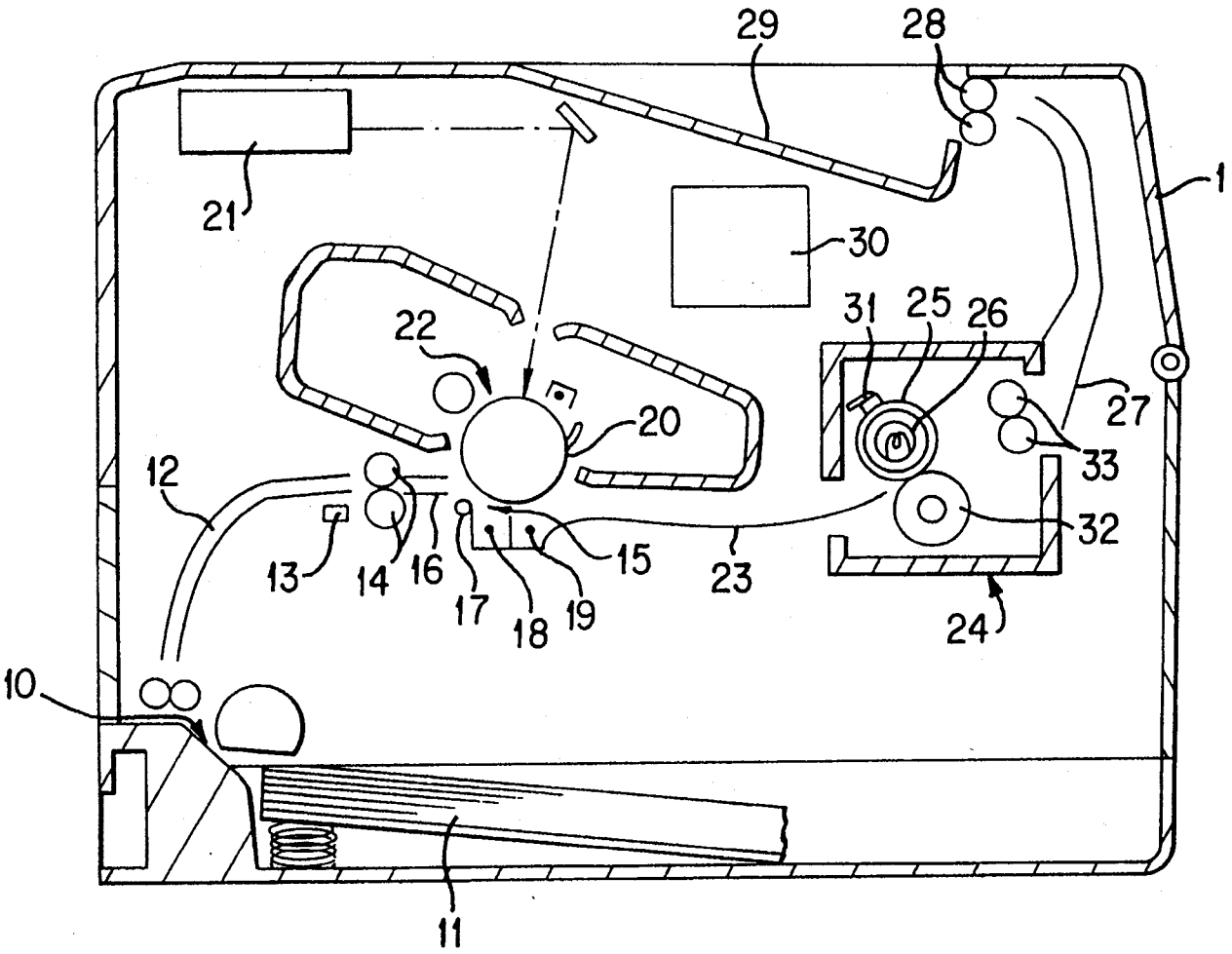
FIG. 4 PRIOR ART
FIG. 4 is a schematic diagram showing the laser printer according to this embodiment.

An embodiment of this invention will be described hereunder with reference to the accompanying drawings. In this embodiment, the electrophotographic device of this invention is applied to a laser printer although the invention is not meant to be limited thereto. The invention can be applied to any electrophotographic device known to those having ordinary skill in the art. The whole construction of the laser printer is identical to that of a conventional technique (see FIG. 4), and thus, the detailed description thereof is eliminated. The same elements as the conventional technique are represented by the same reference numerals.

Figure 1:
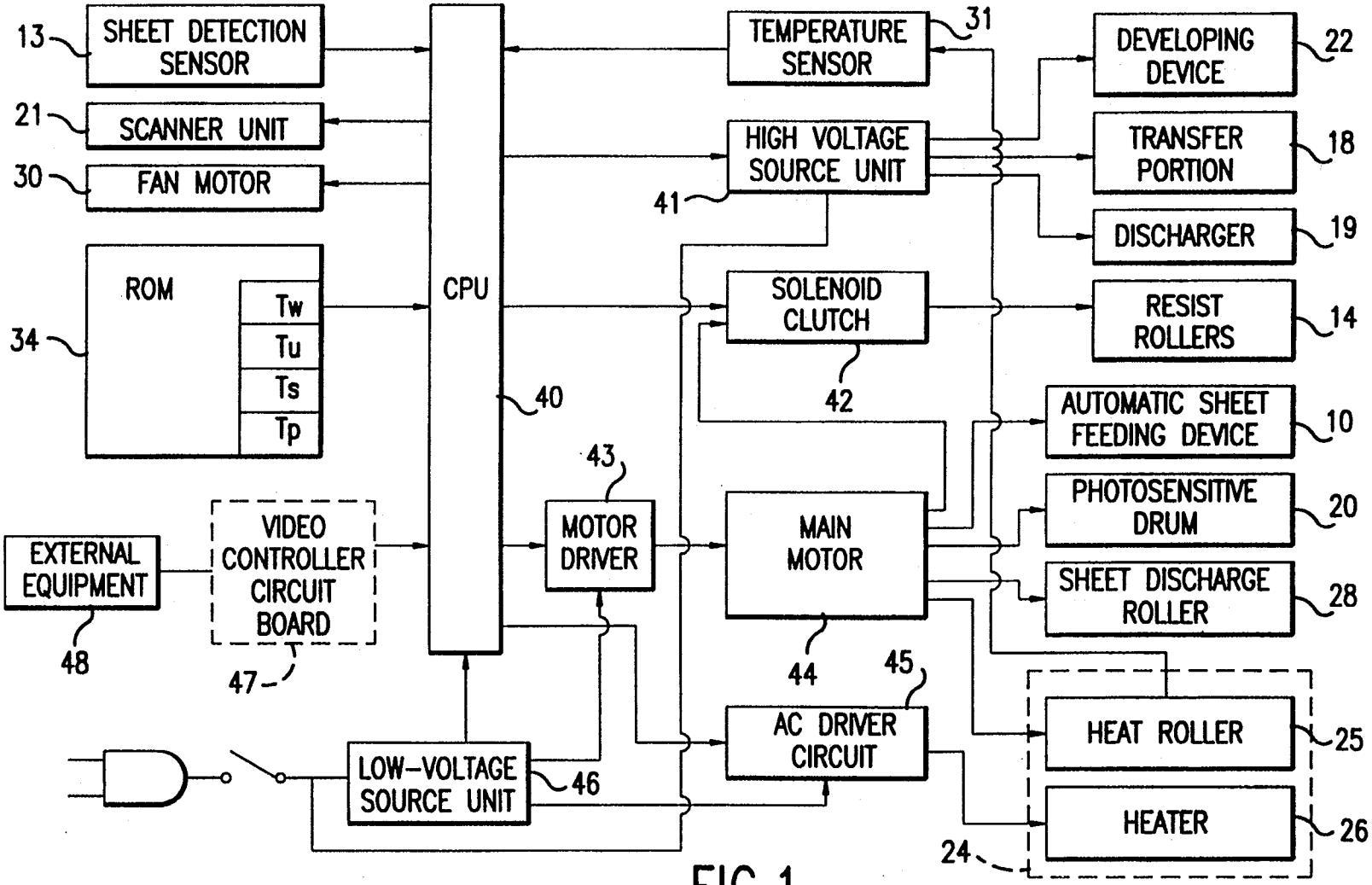
FIG. 1 is a block diagram showing an electrical construction of a laser printer according to this embodiment.

The control system of the laser printer according to this embodiment will be described with reference to FIG. 1.

A CPU 40, which is a main element of the control system of the laser printer, is connected through a bus to a sheet detection sensor 13, a scanner unit 21, a fan motor 30, a ROM 34, a temperature sensor 31, a high-voltage source unit 41, a solenoid clutch 42, a motor driver 43, an AC driver circuit 45, a video controller circuit board 47, and a low-voltage source unit 46. The CPU 40 is supplied with a voltage from the low-voltage source unit 46.

The fan motor 30 is controlled by the CPU 40. Upon start of a print operation, a heater 26 in the fixing device 24 is turned on, and at the same time, the fan motor starts its rotational motion, whereby warmed air in the printer body 1 is discharged to the outside to cool the printer.

The high-voltage source 41 generates plural high voltages that are controlled by the CPU 40, and these high voltages are supplied to the developing device 22, the transfer portion 18 and the discharger 19. The high-voltage applying means of this invention is constructed by the high-voltage source unit 41 and the developing device 22. The transfer portion 18 and the discharger 19 constitute the image forming portion of this invention.

The ROM 34 stores therein a stand-by temperature Tw of the heat roller 25 that is detected by the temperature sensor 31, a temperature Tv that is detected by the temperature sensor 31 and at which the high voltage is applied to the developing device 22, a temperature Ts that is detected by the temperature sensor 31 and at which the sheet feeding of the sheet 11 is started, and a fixing temperature Tp that is detected by the temperature sensor 31 and is required for a toner image on the sheet 11 to be fully fixed on the sheet 11 in the fixing device.

The motor driver 43 drives the main motor 44, and the main motor 44 is connected to each of the automatic sheet feeding device 10, the photosensitive drum 20, the sheet discharge roller 28 and the heat roller 25. Each of these elements can be controlled by the CPU 40. The main motor 44 can drive the resist rollers 14 through the CPU 40 and the solenoid clutch 42, and the driving of the resist rollers 14 is controlled by the CPU 40.

The AC driver circuit 45 is a circuit for controlling an AC power source through the CPU 40 and the heater 26, serving as the heating means of this invention. The temperature sensor 31, serving as the temperature detection means of this invention, transmits information on the temperature of the heat roller 25 in the fixing device 24 to the CPU 40, and the CPU 40 controls the turn-on and turn-out operation of the heater 26 through the AC driver circuit 45 on the basis of the temperature of the heat roller 25. The sheet detection sensor 13 transmits a signal to the CPU 40 when detecting the fed sheet. The video controller circuit board 47 serves to develop a print content, a print command, etc. transmitted from an external equipment 48 into a specific print data, and the CPU 40 controls the scanner unit 21 on the basis of the print data. The CPU 40 performs data communication with the video controller circuit board 47, and informs a user of an engine status (as to whether any abnormality occurs).

An operation of the laser printer thus constructed will be described with reference to flowcharts of FIGS. 2 and FIGS. 3A and 3B. In the following description, Si (i=1, 2, 3, . . . ) represents each step of the flowcharts.

Figure 2:
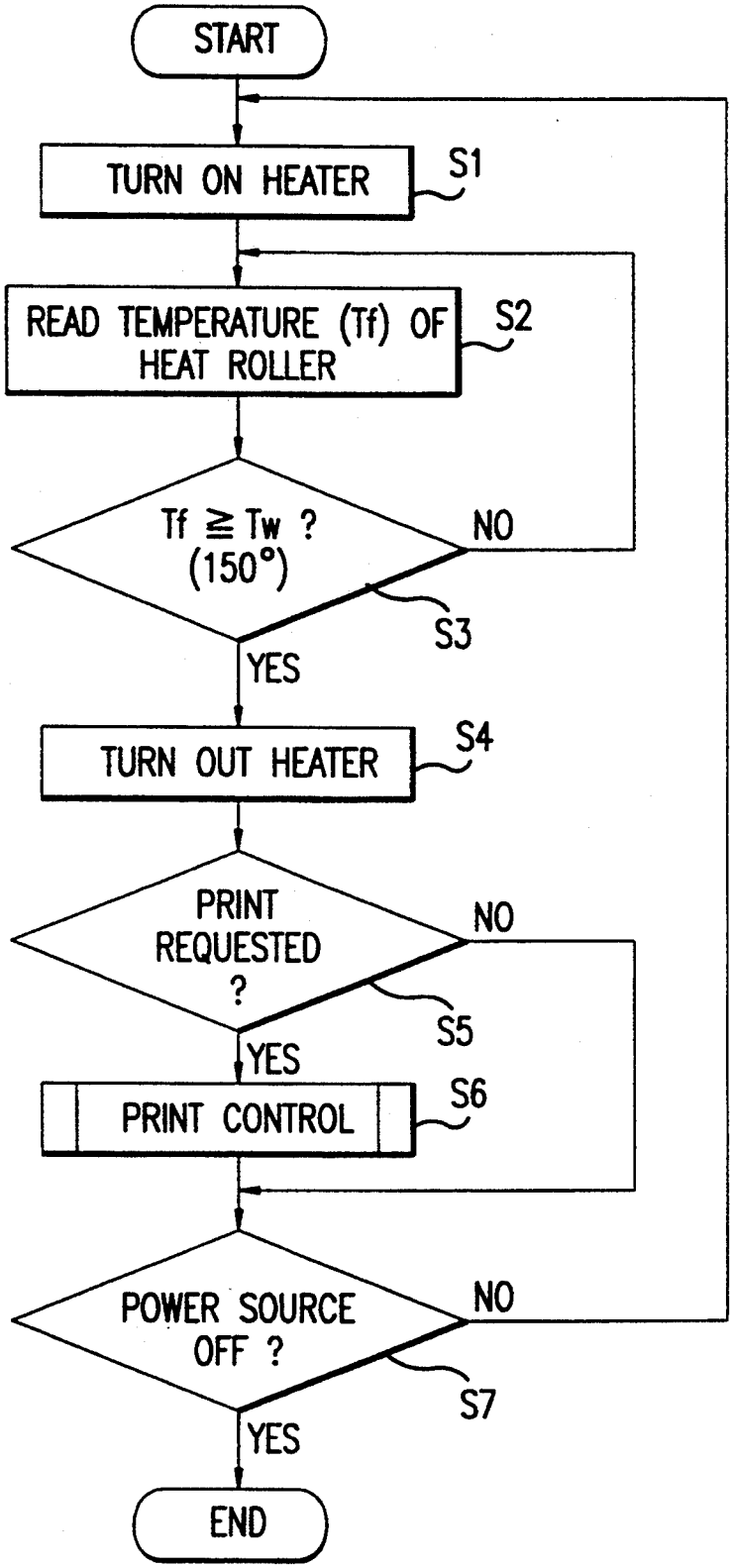
FIG. 2 is a flowchart showing an operation of the laser printer according to this embodiment.
Figure 3A:
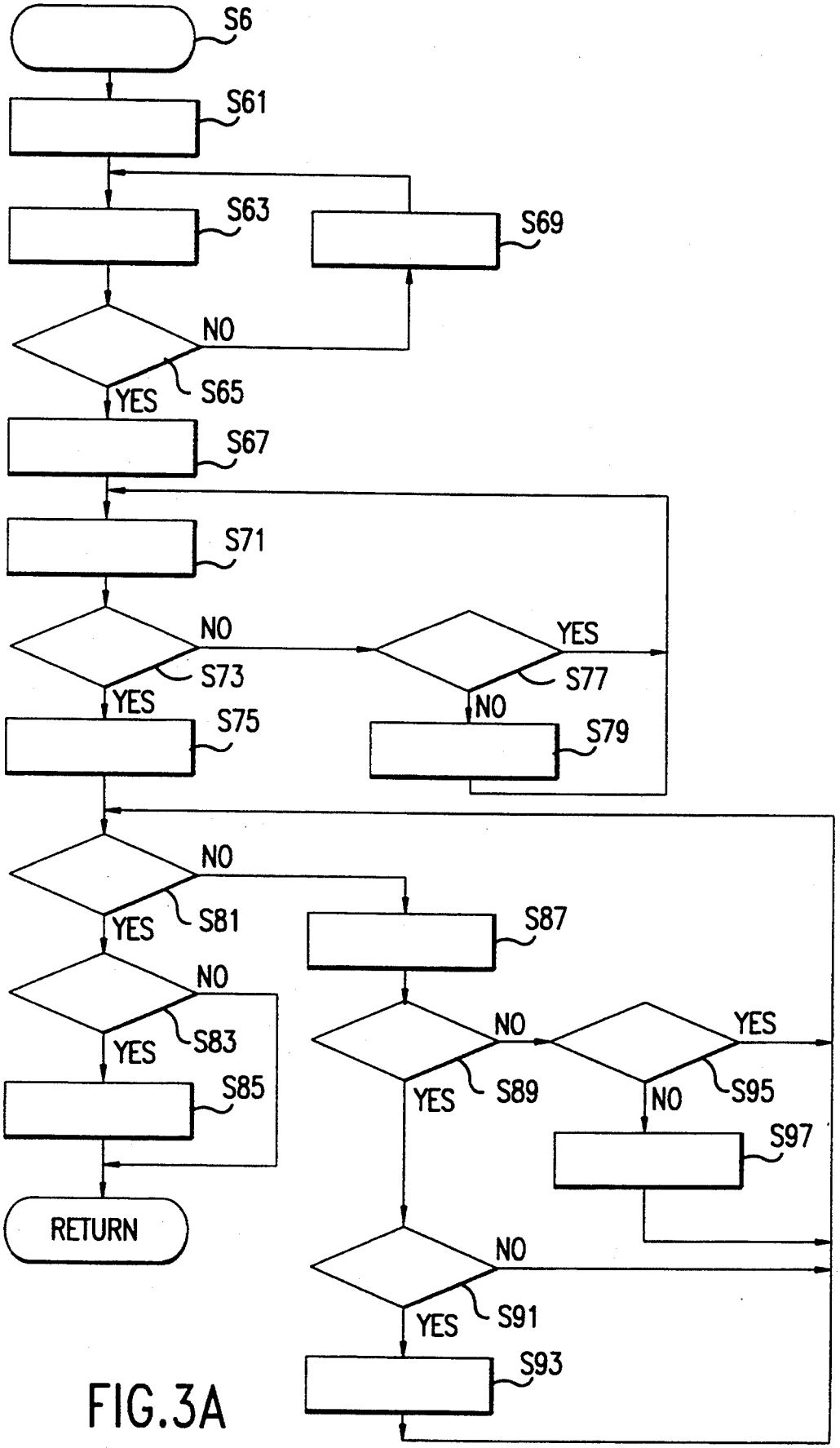

Upon power-on of the laser printer, the CPU 40 carries out a predetermined initial setting and carries out its operation on the basis of the flowcharts of FIGS. 2 and FIGS. 3A and 3B.

First, the heater 26 is turned on (S1), and the temperature Tf of the heat roller 25 is detected by the temperature sensor 31 provided adjacent the heat roller 25 (S2). Thereafter, it is judged whether the temperature detected by the temperature sensor 31 is above the standby temperature Tw of the heat roller, which is beforehand set, for example, above 150° C. (S3). If the temperature Tf of the heat roller 25 is judged to be above 150° C. (S3:YES), the heater 26 is turned out (S4). On the other hand, if the temperature Tf of the heat roller 25 is lower than 150° C. (S3:NO), the process returns to the step S2 to again detect the temperature of the heat roller 25.

Next, when a print instruction is output to the external equipment 48 by a user, the print instruction is transmitted to the video controller circuit board 47, and the CPU 40 receives a print start signal from the video controller circuit board 47 to judge, on the basis of the signal, whether the print operation is started (S5). If the start of the print operation is instructed (S5:YES), a subroutine control (S6) of the print control is started, and the sheet 11 is fed from the sheet feeding device 10.

On the other hand, if the start of the print operation is not instructed (S5:NO) and the subroutine (S6) of the print control is terminated, it is judged whether the laser printer is powered off (S7). If the power is judged to be off (S7:YES), this control is terminated. If the power is judged not to be off (S7:NO), the process returns to the step S1.

The subroutine of the print control will be next described with reference to FIGS. 3A and 3B.

When the start of the print operation is instructed by the CPU 40, the sheet 11 is fed to the resist rollers 14, and is in a standby state (S61). The temperature Tf of the heat roller 25 is detected by the temperature sensor 31 (S63). Thereafter, it is judged whether the detected temperature Tf is above the temperature Tv applied to the high voltage, for example, above 158° C. (S65). If the detected temperature Tf is judged to be above 158° C. (S65:YES), a high voltage is applied from the high-voltage source unit 41 to the developing device 22 (S67).

On the other hand, if the detected temperature is judged not to be above 158° C. (S65:NO), the heater 26 of the fixing device 24 is turned on through the AC driver circuit 45 to raise the temperature of the heat roller 25 (S69), and the process returns to the step S69 to again detect the temperature Tf of the heat roller 25. The above operation is repeated until the temperature Tf of the heat roller 25 reaches, for example, 158° C., which is the temperature Tv at which the high voltage is applied.

After the high voltage is applied to the developing device 22 (S67), the temperature Tf of the heat roller 25 is detected by the temperature sensor 31 (S71), and it is judged whether the detected temperature is above the temperature Ts at which the sheet feeding operation of the sheet 11 is started, for example, above 165° C. (S73). If the temperature Tf of the heat roller 25 is judged to be above 165° C. (S73:YES), the solenoid clutch 42 is switched on, and the sheet 11, which is on standby by the resist rollers 14, starts its feeding operation (S75).

On the other hand, if the temperature Tf of the heat roller 25 is judged not to be above 165° C. (S73:NO), it is judged whether the heater 26 has been turned on (S77). If the heater 26 has been turned on, the process returns to the step S71. If the heater 26 has not been turned on, the heater 26 is turned on (S79), and the process returns to the step S71 to again detect the temperature of the heat roller 25. At this time, if the temperature Tf of the heat roller 25 is judged not to be above 165° C., the solenoid clutch 42 is not switched on, and thus, the resist rollers 14 are not driven. Therefore, the sheet 11 is kept on standby at the resist rollers 14, and the above operation is repeated until the temperature Tf of the heat roller 25 reaches 165° C., which is the temperature Ts at which the sheet feeding operation of the sheet 11 is started.

After the sheet feeding operation of the sheet 11 is started (S75), it is judged whether the print operation is terminated (S81). If the print operation is terminated (S81:YES), it is judged whether the heater 26 is turned on (S83). If the heater 26 is judged to be turned on, the heater 26 is turned out (S85) to terminate the subroutine of the print control, and the process returns to the main routine. If the heater 26 is judged not to be turned on, the subroutine of the print control is terminated, and the process returns to the main routine.

On the other hand, if the printing operation is not terminated (S81:NO), the temperature Tf of the heat roller 25 is detected by the temperature sensor 31 (S87). Thereafter, it is judged whether the detected temperature Tf is above 170° C., which is the beforehand-set fixing temperature Tp (S89). Here, the fixing temperature Tp is defined as a temperature required to fully fix the toner image on the sheet 11 in the fixing device 24. If the temperature Tf of the heat roller 25 is judged to be above 170° C. (S89:YES), it is judged whether the heater 26 is turned on (S91). If the heater 26 is judged to be turned on, the heater 26 is turned out (S93). If the heater 26 is judged not to be turned on, the process returns to the step S69 to judge whether the print operation is terminated.

On the other hand, if the temperature Tf is judged not to be above 170° C. (S89:NO), it is judged whether the heater is turned on (S95). If the heater is judged not to be turned on, the heater 26 is turned on (S97). On the other hand, if the heater is judged to be turned on, the process returns to the step S69. The above operation is repeated until the print operation is terminated.

As described above, the fixing temperature Tp is defined as a temperature that is detected by the temperature sensor 31 and at which the toner image on the sheet 11 will be fully fixed on the sheet 11 in the fixing device 24.

The temperature Tf detected by the temperature sensor 31 to start the feeding operation of the sheet 11 is set to such a value that the temperature Tf of the heat roller 25 reaches the fixing temperature Tp of the heat roller 25, for example, 170° C. from the start of the feeding of the sheet 11 until the arrival of the sheet 11 at the fixing device 24.

The temperature Tv detected by the temperature sensor 31 to apply the high voltage to the developing device 22 is set to such a value that a time required from the time when the high voltage is applied to the developing device 22 until the time when the sheet 11 on standby by the resist rollers 14 reaches the image forming portion 15 is equal to an optimum time for charging the photosensitive drum 20.

As described above, during a period from the time when the print start instruction is output until the time when the temperature of the heat roller 25 reaches the predetermined fixing temperature Tp, that is, for example, 170° C., high voltage is applied at the time when the temperature of the heat roller 26 reaches 158° C., and the feeding operation of the sheet 11 is carried out at the time when the temperature of the heat roller 26 reaches 165° C., so that the first print time is shortened. Conventionally, about 23 to 24 seconds are required to complete the print operation. However, in the laser printer of this embodiment, only about 18 seconds are required to complete the print operation. Therefore, the first print time can be shortened by about five seconds.

This invention is not limited to the above embodiment, and any modification may be made without departing from the subject matter of this invention.

For example, in the above embodiment, after the high voltage is applied to the developing device 22, the temperature Tf of the heat roller 25 is detected by the temperature sensor 31 to judge whether the detected temperature is above the predetermined temperature at which the feeding operation of the sheet 11 is started, for example, above 165° C. If the temperature Tf of the heat roller 25 is judged to be above 165° C., the solenoid clutch 42 is switched on to start the feeding operation of the sheet 11, which is kept on standby by the resist rollers 14. In this case, if the photosensitive drum 20 is fully charged during the time required to feed the sheet 11 from the resist rollers 14 to the photosensitive drum 20, the application of the high voltage to the developing device 22 and the start of the feeding operation of the sheet 11 may be simultaneously carried out.

Figure 5A:
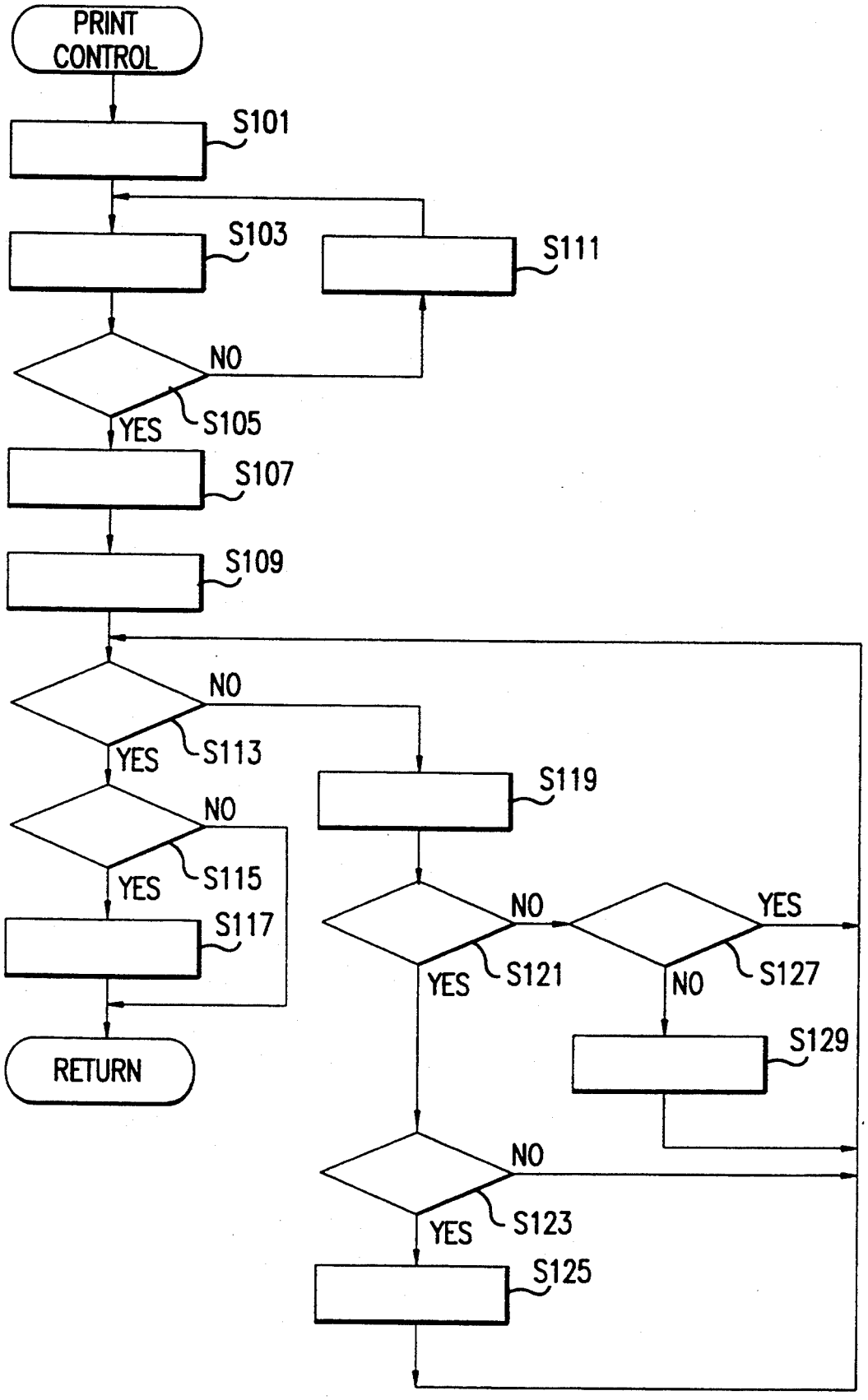

A second embodiment in which the application of the high voltage to the developing device 22 and the start of the feeding operation of the sheet 11 are simultaneously carried out will be described with reference to FIGS. 5A and 5B.

When the start of the print operation is instructed by the CPU 40, the sheet 11 is fed to the resist rollers 14, which are on standby at this position (S101). Subsequently, the temperature Tf of the heat roller 25 is detected by the temperature sensor 31 (S103). Thereafter, it is judged whether the detected temperature Tf is above a predetermined temperature Ts at which the high voltage is applied, and the feeding operation of the sheet 11 is started, for example, above 165° C. (S105). If the detected temperature Tf is judged to be above 165° C. (S105:YES), high voltage is applied (S107), and the solenoid clutch 42 is switched on to start the feeding operation of the sheet 11 by the resist rollers 14 (S109).

On the other hand, if the temperature of the heat roller 25 is judged not to be above 165° C. (S105:NO), the heater 26 of the fixing device is turned on through the AC driver circuit 45 to raise the temperature of the heat roller 25 (S111), and the process returns to the step S103 to again detect the temperature of the heat roller 25. If at this time the temperature Tf of the heat roller 25 is judged not to be above 165° C., the solenoid clutch 42 is not switched on, and thus, the resist rollers 14 are not driven. Therefore, the sheet 11 is left on standby at the resist rollers 14, and the above operation is repeated until the temperature Tf of the heat roller 25 reaches the temperature Ts at which the feeding operation of the sheet 11 is started, that is, 165° C.

After the feeding operation of the sheet 11 is started (S109), it is judged whether the print operation is terminated (S113). If the print operation is judged to be terminated (S113:YES), it is judged whether the heater 26 is turned on (S115). If the heater 26 is judged to be turned on, the heater 26 is turned out (S117) to terminate the subroutine of the print control, and the process returns to the main routine. If the heater 26 is judged not to be turned on, the subroutine of the print control is directly terminated, and the process returns to the main routine.

On the other hand, if the print operation is not terminated (S113:NO), the temperature Tf of the heat roller 25 is detected (S119). It is judged whether the detected temperature Tf is above the predetermined fixing temperature Tp, that is, for example, 170° C. (S121). The fixing temperature Tp is defined as a temperature that is detected by the temperature sensor 31 and required to fully fix the toner image on the sheet 11 in the fixing device 24.

If the temperature Tf of the heat roller 25 is judged to be above 170° C. (S121:YES), it is judged whether the heater is turned on (S123). If the heater 26 is judged to be turned on, the heater 26 is turned out (S125). If the heater is judged not to be turned on, the process returns to the step S113 maintaining its state, and it is judged whether the print operation is terminated. On the other hand, if the temperature Tf is judged not to be above 170° C. (S121:NO), it is judged whether the heater 26 is turned on (S127). If the heater 26 is judged not to be turned on, the heater 26 is turned on (S129). If the heater 26 is judged to be turned on, the process directly returns to the step S113, and it is judged whether the print operation is terminated.

What is claimed is:

1. An electrophotographic device in which a developing agent image formed on an image support member is transferred onto a transfer member to form an image in an image forming portion and which has a fixing device for heat-fixing the image formed on the transfer member, the electrophotographic device comprising:

heating means for heating said fixing device;

temperature detection means for detecting temperature of said fixing device heated by said heating means;

high-voltage applying means for applying a high voltage to said image forming portion;

sheet feeding means for feeding a sheet to said image forming portion; and control means for controlling said sheet feeding means to feed the sheet to said image forming portion (1) before the temperature detected by said temperature detection means reaches a predetermined value and (2) one of simultaneously with and after the application of high voltage by said high-voltage applying means.

2. An electrophotographic device in which a developing agent image formed on an image support member is transferred onto a transfer member to form an image in an image forming portion and which has a fixing device for heat-fixing the image formed on the transfer member, the electrophotographic device comprising:

heating means for heating said fixing device;

temperature detection means for detecting temperature of said fixing device heated by said heating means;

high-voltage applying means for applying a high voltage to said image forming portion;

sheet feeding means for feeding a sheet to said image forming portion; and control means for controlling said sheet feeding means to feed the sheet to said image forming portion before the temperature detected by said temperature detection means reaches a predetermined value, wherein said control means comprises first comparison means for comparing the temperature of said fixing device with a first temperature lower than the predetermined value, and second comparison means for comparing the temperature of said fixing device with a second temperature lower than the first temperature, wherein when the temperature of said fixing device is judged to be above the second temperature by said second comparison means, said high-voltage applying means applies the high voltage to said image forming portion, and when the temperature of said fixing device is judged to be above the first temperature by said first comparison means, said sheet feeding means feeds the sheet.

3. The electrophotographic device as claimed in claim 2, wherein said heating means heats said fixing device to at least the predetermined value before the sheet arrives at said fixing device.

4. The electrophotographic device as claimed in claim 3, wherein the predetermined value is a temperature value at which the image is fully fixed on the transfer member by said fixing device.

5. The electrophotographic device as claimed in claim 2, wherein the second temperature is determined such that a time from when said high-voltage applying means applies the high voltage until when the sheet reaches said image forming portion is an optimum time.

6. The electrophotographic device as claimed in claim 2, wherein said heating means heats said fixing device to at least the predetermined value when the sheet arrives at said fixing device.

7. The electrophotographic device as claimed in claim 2, wherein said control means comprises third comparison means for comparing the temperature of said fixing device with a third temperature lower than the second temperature, and when the temperature of said fixing device is judged to be below the third temperature by said third comparison means, said heating means heats said fixing device.

8. An electrophotographic printing apparatus for transferring an electrostatic latent image formed on a photosensitive drum to a printing sheet via a developing device, the apparatus comprising:

a fixing device comprising a heater and a heat roller, the heat roller being heated by said heater;

a temperature sensor mechanically coupled to the heat roller for detecting the temperature of the heat roller;

a sheet feeder feeding the printing sheet to resist rollers;

a high-voltage source unit electrically connected to the developing device, the high-voltage source unit applying a high voltage to the developing device when the temperature sensor detects that a temperature of the heat roller is above a first predetermined temperature;

a solenoid clutch cooperating with the resist rollers, the solenoid clutch activating rotation of the resist rollers when the temperature sensor detects that a temperature of the heat roller is above a second predetermined temperature, higher than said first predetermined temperature; and a controller receiving input from the temperature sensor and controlling the high-voltage source unit and the solenoid clutch in accordance with the temperature of the heat roller.

9. An electrophotographic device as claimed in claim 8, wherein said controller controls said feeder to feed the printing sheet simultaneously with the application of the high voltage by said high-voltage source unit.

10. An electrophotographic device as claimed in claim 8, wherein said controller controls said feeder to feed the printing sheet after the application of the high voltage by said high-voltage source unit.

11. The electrophotographic device as claimed in claim 8, wherein said heater heats said fixing device to at least a third predetermined temperature before the sheet arrives at said fixing device after said sheet feeder feeds the sheet.

12. The electrophotographic device as claimed in claim 11, wherein the third predetermined temperature is a temperature value at which the image is fully fixed on the printing sheet by said fixing device.

13. The electrophotographic device as claimed in claim 8, wherein the first predetermined temperature is determined such that a time from when said high-voltage source unit applies the high voltage until when the printing sheet reaches said developing device is an optimum time for charging the photosensitive drum.

14. The electrophotographic device as claimed in claim 8, wherein said heater heats said fixing device when the temperature of said fixing device is judged to be below a stand-by temperature lower than said first predetermined temperature.

15. A method of transferring an electrostatic latent image to a printing substrate via an image forming device having a heat roller, the method comprising the steps of:

detecting a first temperature of said heat roller;

applying a high voltage to said image forming device if said first temperature is above a first predetermined temperature;

detecting a second temperature of said heat roller;

feeding said printing substrate to said image forming device if said second temperature is above a second predetermined temperature higher than said first predetermined temperature; and controlling said high-voltage applying step and said feeding step in accordance with the detecting steps.

16. A method according to claim 15, wherein said controlling step further comprises the step of causing said heat roller to reach a third predetermined temperature higher than said second predetermined temperature simultaneously with completion of said feeding step.

17. A method according to claim 15, wherein said controlling step comprises the step of controlling said feeding step to feed the printing substrate simultaneously with the application of the high voltage in said high-voltage applying step.

18. A method according to claim 15, wherein said controlling step further comprises the step of controlling said feeding step to feed the printing substrate after the application of the high voltage in said high-voltage applying step.

* * * * *